US006371203B2

(12) United States Patent
Frank et al.

(10) Patent No.: US 6,371,203 B2
(45) Date of Patent: Apr. 16, 2002

(54) METHOD OF CREATING A WELLBORE IN AN UNDERGROUND FORMATION

(75) Inventors: Timothy John Frank; Robert Joe Coon, both of Houston, TX (US); David Martin, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/771,005

(22) Filed: Jan. 26, 2001

Related U.S. Application Data

(63) Continuation of application No. 09/289,882, filed on Apr. 9, 1999.

(51) Int. Cl.[7] ..... E21B 23/00
(52) U.S. Cl. ..... 166/207; 175/23
(58) Field of Search ..... 166/207; 175/23, 175/171

(56) References Cited

U.S. PATENT DOCUMENTS

| | | | | |
|---|---|---|---|---|
| 3,162,245 | A | 12/1964 | Howard et al. | 166/63 |
| 3,167,122 | A | 1/1965 | Lang | 166/14 |
| 3,203,483 | A | 8/1965 | Vincent | 166/207 |
| 3,326,293 | A | 6/1967 | Skipper | 166/150 |
| 3,489,220 | A | 1/1970 | Kinley | 166/277 |
| 3,785,193 | A | 1/1974 | Kinley et al. | 72/393 |
| 4,483,399 | A | 11/1984 | Colgate | 166/207 |
| 5,014,779 | A | 5/1991 | Meling et al. | 166/55.7 |
| 5,031,699 | A | 7/1991 | Artynov et al. | 166/285 |
| 5,083,608 | A | 1/1992 | Abdrakhmanov et al. | 166/55 |
| 5,366,012 | A | 11/1994 | Lohbeck | 166/277 |
| 5,535,824 | A | 7/1996 | Hudson | 166/207 |
| 6,021,850 | A | 2/2000 | Wood et al. | 166/207 |

FOREIGN PATENT DOCUMENTS

| | | |
|---|---|---|
| DE | 1583992 | 6/1971 |
| EP | 0911483 | 4/1999 |
| GB | 2326896 | 1/1999 |
| WO | 93/25799 | 12/1993 |
| WO | 97/17524 | 5/1997 |
| WO | 97/20130 | 6/1997 |
| WO | 99/35368 | 7/1999 |

OTHER PUBLICATIONS

*Metal Forming–Mechanics and Metallurgy*, Chapter 3, 2nd Ed.. Prentice Hall. New Jersey, 1993.

International Search Report dated Jul. 14, 2000.

*Metal Forming–Mechanics and Metallurgy, Chapters 3 and 17*, 2nd Ed., Prentice Hall, New Jersey, 1993.

*Metals Handbook, Forming and Forging*, pp. 7, 373–387, and 874–899, 9th Ed., vol. 14, ASM International, Metals Park, OH (USA) 1993.

*Failure of Materials in Mechanical Design*, J.A. Collins, Chapter 3.5, pp. 34–37, 2nd Ed., John Wiley & Sons, New York (USA) 1993.

*Primary Examiner*—William Neuder

(57) ABSTRACT

A method of creating a wellbore in an underground formation comprising drilling a borehole in the underground formation using a drilling tubular, capable of being expanded, to which a downhole motor driving a drill bit has been connected, and, after drilling to the desired casing setting depth, expanding the drilling tubular into place to line the borehole by applying a radial load to the drilling tubular and removing said load from the drilling tubular.

12 Claims, 3 Drawing Sheets

METHOD OF CREATING A WELLBORE IN AN UNDERGROUND FORMATION

CROSS REFERENCE TO RELATED APPLICATION

The present application is a continuation of patent application Ser. No. 09/289,882 filed Apr. 9, 1999.

FIELD OF THE INVENTION

The invention relates to a method of creating a wellbore in an underground formation comprising drilling a borehole in the underground formation using a drilling tubular, capable of being expanded, to which a downhole motor driving a drill bit has been connected, and, after drilling to the desired casing setting depth, expanding the drilling tubular into place to line the borehole by applying a radial load to the drilling tubular and removing said load from the tubular after the expansion.

BACKGROUND OF THE INVENTION

Expansion methods and devices are disclosed in German patent specification No. 1583992 and in U.S. Pat. Nos. 3,162,245 to Howard et al; 3,167,122 to Lang; 3,203,483 to Vincent; 3,326,293 to Skipper; 3,489,220 to Kinley; 3,785,193 to Kinley et al; 5,014,779 Meling et al; 5,031,699 to Artynov et al; 5,083,608 to Abdrakhmanov et al; and 5,366,012 to Lohbeck.

Many of the known expansion methods employ an initially corrugated tube and the latter prior art reference employs a slotted tube which is expanded downhole by an expansion mandrel.

The use of corrugated or slotted pipes in the known methods serves to reduce the expansion forces that need to be exerted to the tube to create the desired expansion.

SUMMARY OF THE INVENTION

It is an object of the present invention to provide a method for expanding a solid, i.e. unslotted, tubing which requires exertion of a force to expand the tubing and which provides a tubing having a larger diameter and higher strength than the unexpanded tubing and which can be carried out with a tubing which already may have a tubular shape before expansion.

There is provided a method of creating a wellbore in an underground formation comprising drilling a borehole in the underground formation using a drilling tubular, capable of being expanded, to which a downhole motor driving a drill bit has been connected, and, after drilling to the desired casing setting depth, expanding the drilling tubular into place to line the borehole by applying a radial load to the drilling tubular and removing the load from the drilling tubular.

BRIEF DESCRIPTION OF THE DRAWINGS

The present invention will now be described, by way of example, with reference to the accompanying drawings, in which.

DETAILED DESCRIPTION

Figure 2:
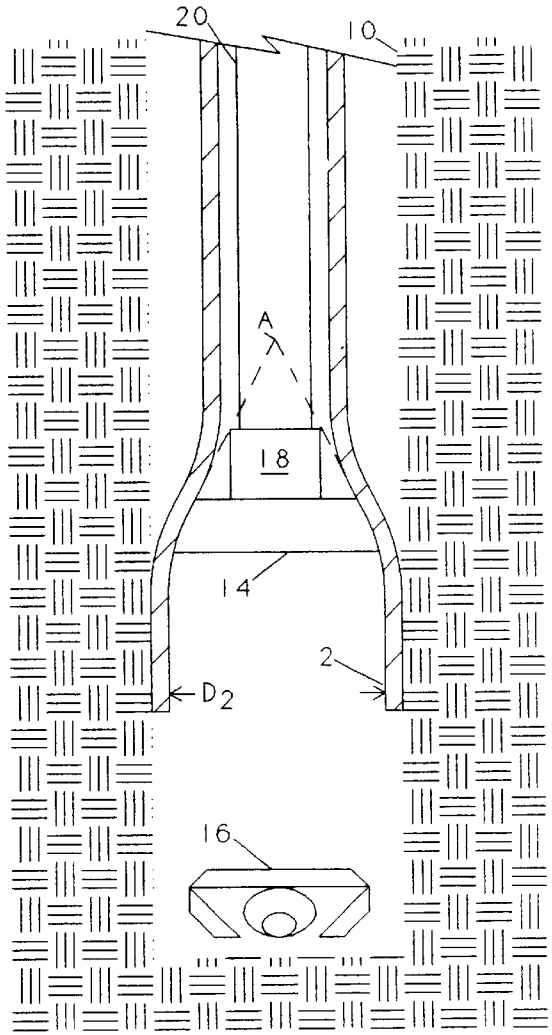
FIG. 2 is a diagrammatic representation of the present invention, similar to FIG. 1, showing the expansion of the liner.

The method according to the invention thereto comprises the step of moving an expansion mandrel through solid drilling tubing thereby at least partially plastically expanding the tubing against the borehole wall. The solid tubing, which is expanded, is made of a formable steel grade which is subject to strain hardening without incurring any necking and ductile fracturing as a result of the expansion process. The expansion mandrel used has a non-metallic tapering surface along at least part of its length.

As a result of strain hardening, the tubing becomes stronger during the expansion process. Any further increment of expansion always requires a higher stress than for the preceding expansion.

It has been found that the use of a formable steel grade for the tubing, in combination with a non-metallic tapering surface of the expansion mandrel, has a synergetic effect since the resulting expanded tubing will have an adequately increased strength while the expansion forces remain low.

It is observed that, in the art of metallurgy, the terms strain-hardening and work-hardening are synonyms and are both used to denote an increase of strength caused by plastic deformation.

The term formable steel grade as used in this specification means that the tubing is able to maintain its structural integrity while being plastically deformed into various shapes.

Ways of determining forming characteristics of a steel are set out in the *Metals Handbook,* 9th edition, Volume 14, *Forming and Forging*, issued by ASM International, Metals Park, Ohio (USA).

The term necking refers to a geometrical effect leading to non-uniform plastic deformations at some location by occurrence of a local constriction. From the point of necking on, the continual work hardening in the necked region no longer compensates for the continual reduction of the smallest cross section in the neck and, therefore, the load carrying capacity of the steel decreases. With continuing loading, practically all further plastic deformation is restricted to the region of the neck, so that a highly non-uniform deformation occurs to develop in the necked region until fracture occurs.

The term ductile fracturing means that a failure occurs if plastic deformation of a component that exhibits ductile behavior is carried to the extreme so that the component separates locally into two pieces. Nucleation, growth and coalescence of internal voids propagate to failure, leaving a dull fibrous rupture surface. A detailed description of the terms necking and ductile fracturing is given in the handbook *Failure of Materials in Mechanical Design* by J. A. Collins, second edition, issued by John Wiley and Sons, New York (USA) in 1993.

Preferably the tubing is made of a high-strength steel grade with formability and having a yield strength-tensile strength ratio which is lower than 0.8 and a yield strength of at least 275 MPa. When used in this specification, the term high-strength steel denotes a steel with a yield strength of at least 275 MPa.

It is also preferred that the tubing is made of a formable steel grade having a yield stress/tensile stress ratio which is between 0.6 and 0.7.

Dual phase (DP) high-strength, low-alloy (HSLA) steels lack a definite yield point which eliminates Luders band formation during the tubular expansion process which ensures good surface finish of the expanded tubular.

Suitable HSLA dual phase (DP) steels for use in the method according to the invention are grades DP55 and DP60 developed by Sollac having a tensile strength of at least 550 MPa and grades SAFH 540 D and SAFH 590 D developed by Nippon Steel Corporation having a tensile strength of at least 540 MPa.

Other suitable steels are the following formable high-strength steel grades

- an ASTM A106 high-strength low alloy (HSLA) seamless pipe;
- an ASTM A312 austenitic stainless steel pipe, grade TP 304 L;
- an ASTM A312 austenitic stainless steel pipe, grade TP 316 L; and
- a high-retained austenite high-strength hot-rolled steel (low-alloy TRIP steel) such as grades SAFH 590 E, SAFH 690 E and SAFH 780 E developed by Nippon Steel Corporation.

The above-mentioned DP and other suitable steels each have a strain hardening exponent n of at least 0.16 which allows an expansion of the tubing such that the external diameter of the expanded tubing is at least 20% larger than the external diameter of the unexpanded tubing. Detailed explanations of the terms strain hardening, work hardening and the strain hardening exponent n are given in chapters 3 and 17 of the handbook *Metal Forming-Mechanics and Metallurgy,* 2nd edition, issued by Prentice Hall, New Jersey (USA), 1993.

After the radial expansion of the drilling tubular, the tubular serves as a liner for the borehole.

The principle behind the present invention is that by using a one trip drilling and expandable lining system a well 10 can be drilled and lined all in one step by radially expanding the drilling tubular 12 after the drilling.

The system utilizes tubulars 12 that are capable of being radially expanded, i.e. made of a formable steel grade. Therefore, the material of the drilling tubular is advantageously capable of sustaining a plastic deformation of at least 10% uniaxial strain.

The low yield strength and the high ductility of the tubing before expansion enables the use of a tubing which is reeled on a reeling drum. Therefore the drilling tubular, is preferably stored on a reel before the drilling and unreeled from the reel into the borehole during the drilling.

Figure 1:
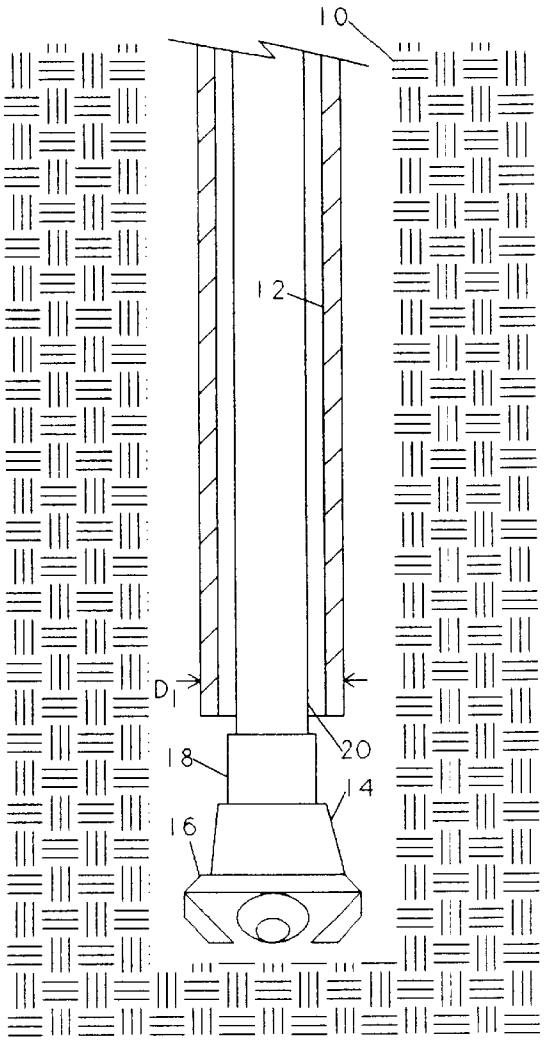
FIG. 1 is a diagrammatic representation of a first embodiment of the subject invention prior to expanding the liner.
Figure 2A:
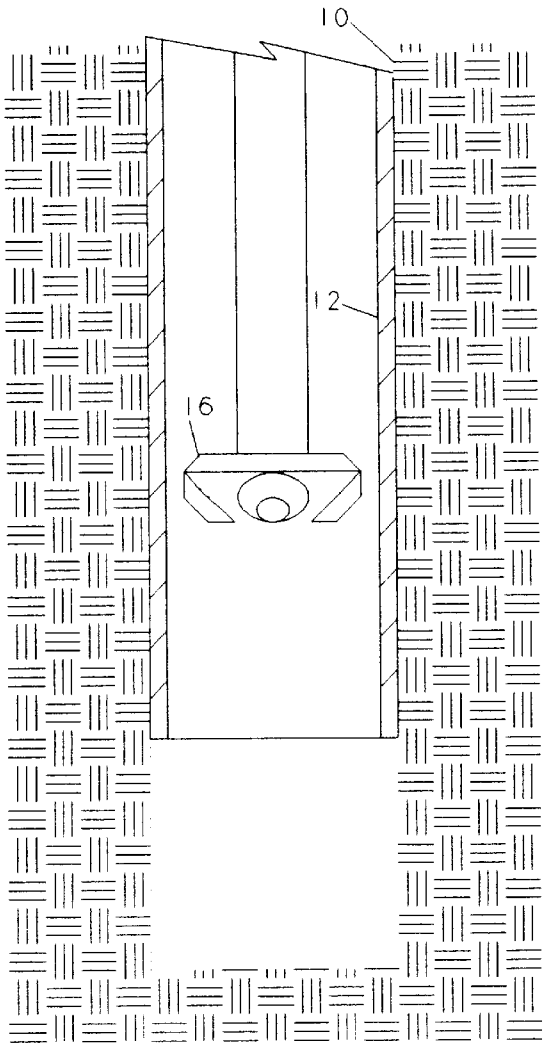

Preferably, an expandable mandrel or swage section 14 (see FIGS. 1 and 2) forms an integral part of downhole motor 18 and the drilling bit 16 and is latched with the drilling tubular and is pulled back through the latching tubular 20 after drilling to the desired casing setting depth. The mandrel expands the drilling tubular on its way out of the wellbore.

Alternatively, an expandable mandrel or swage section is advantageously built on the top of the drilling bit, latched on to it with the drilling tubular and pulled back through the drilling tubular after drilling to the desired casing setting depth. This movement of the mandrel expands the drilling tubular as the former is on its way out the wellbore.

Figure 4:
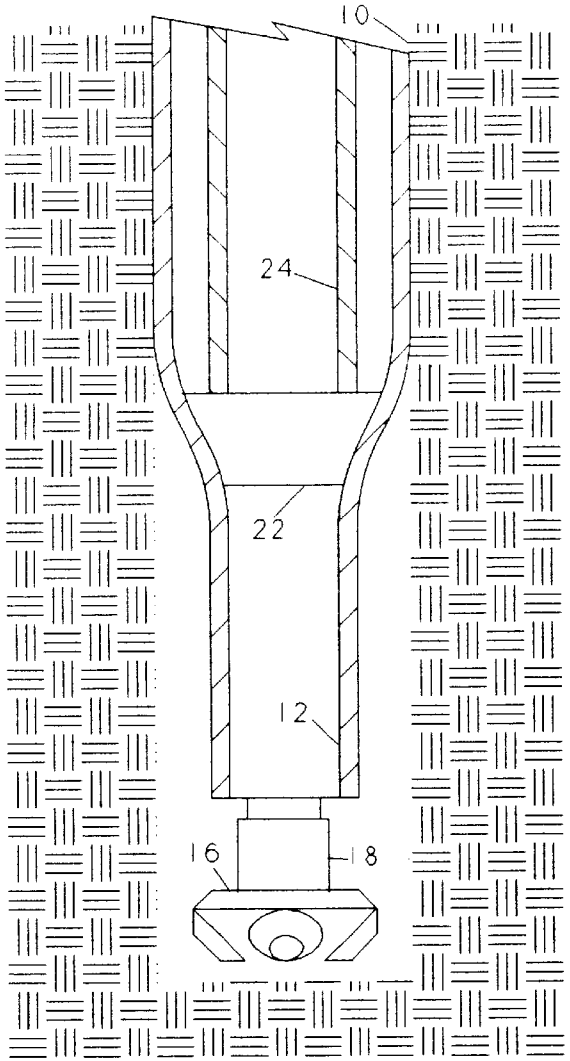
FIG. 4 is a diagrammatic representation of the present invention, similar to FIG. 3, showing the expansion of the liner.
Figure 3:
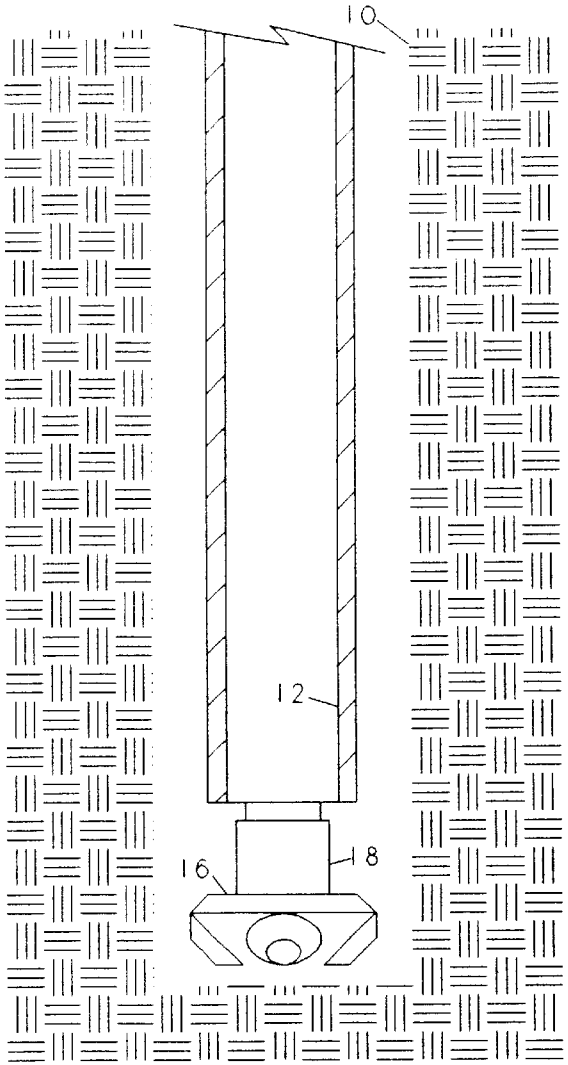
FIG. 3 is a diagrammatic representation of a second embodiment of the subject invention prior to expanding the liner.

According to yet another preferred embodiment of the present invention (see FIGS. 3 and 4) the drilling tubular 12 is expanded after drilling to the desired casing setting depth by moving an expansion unit 22 through it on a vent line 24 from the top until the expansion unit reaches the bottom of the tubular. The expansion unit can then latch onto the drilling bit 16 or device and the drilling continued.

The expansion mandrel is suitably equipped with a series of ceramic surfaces (not shown) which restrict frictional forces between the mandrel and tubing during the expansion process. The semi top angle A of the conical ceramic surface that actually expands the tubing is advantageously about 25°. It has been found that zirconium oxide is a suitable ceramic material which can be formed as a smooth conical ring. Experiments and simulations have shown that if the semi cone top angle A is between 20° and 30° the pipe deforms such that it obtains an S shape and touches the tapering part of the ceramic surface essentially at the outer tip or rim of said conical part and optionally also about halfway the conical part.

Experiments also showed that it is beneficial that the expanding tubing obtains an S-shape since this reduces the length of the contact surface between the tapering part of the ceramic surface and the tubing and thereby also reduces the amount of friction between the expansion mandrel and the tubing.

Experiments have also shown that if said semi top angle A is smaller than 15° this results in relatively high frictional forces between the tube and mandrel, whereas if said top angle is larger than 30° this will involve redundant plastic work due to plastic bending of the tubing which also leads to higher heat dissipation and to disruptions of the forward movement of the mandrel through the tubing. Hence said semi top angle A is preferably selected between 15° and 30° and should always be between 5° and 45°.

Experiments have also shown that the tapering part of the expansion mandrel should have a non-metallic outer surface to avoid galling of the tubing during the expansion process. The use of a ceramic surface for the tapering part of the expansion mandrel furthermore caused the average roughness of the inner surface of the tubing to decrease as a result of the expansion process. The experiments have also shown that the expansion mandrel provided with a ceramic tapering surface could expand a tubing made of a formable steel such that the outer tubing diameter D2 after expansion was at least 20% larger than the outer diameter D1 of the unexpanded tubing and that suitable formable steels are dual phase (DP) high-strength low alloy (HSLA) steels known as DP55 and DP60; ASTM A106 HSLA seamless pipe, ASTM A312 austenitic stainless steel pipes, grades TP 304 L and TP 316 L and a high-retained austenite high-strength hot rolled steel, known as TRIP steel manufactured by the Nippon Steel Corporation.

The mandrel is suitably provided with a pair of sealing rings (not shown) which are located at such a distance from the conical ceramic surface that the rings face the plastically expanded section of the tubing. The sealing rings serve to avoid fluid, at high hydraulic pressure, being present between the conical ceramic surface of the mandrel and the expanding tubing as this might lead to an irregularly large expansion of the tubing.

The expansion mandrel is suitably provided with a central vent passage (also not shown) which is in communication with a coiled vent line (not shown) through which fluid, displaced from the annulus, may be vented to the surface.

Alternatively, this fluid can be forced into the formation behind or below the expanded drilling tubular which serves now as a liner. Depending on the situation the expansion mandrel and/or bit can be left at the bottom of the hole, or through the use of a retrieving head and detachable mounting the mandrel and the bit can be retrieved and pulled back to the surface inside the newly expanded tubular. This may be done by the vent line A coiled kill and/or service line may be lowered into the expanded tubing to facilitate injection of kill and/or treatment fluids towards the hydrocarbon fluid inflow zone. This is normally done via the annulus between the production tubing and the well casing.

Advantageously a sealing material in a fluidic state is pumped between the drilling tubular and the wellbore wall prior to applying said radial load to the drilling tubular. This sealing material sets after the radial expansion thus sealing any remaining annular area. Preferably this sealing material sets by the mechanical energy exerted to it by the radial expansion of the drilling tubular.

Alternatively, the sealing material may set by circulating it between the drilling tubular and the wellbore wall while putting a hardener into it.

Sealing fluids and the corresponding hardeners are well known to the person skilled in the art.

Another very much preferred possibility is the utilization of a drilling fluid that can be turned into an external sealing material after the radial expansion.

By radially expanding the drilling tubular the formation flow is suitably sealed off, if necessary with the aid of a sealing means, as mentioned hereinbefore.

After the borehole has been completed by the radial expansion of the drilling tubular the expansion mandrel is advantageously utilized as a wiper plug for removing any remaining sealing fluid from the inside of the drilling tubular after the expansion. The invention also relates to a wellbore in an underground formation which has been created by the present method.

The advantage of the present method is that it saves time and allows for multiple contingency liners while minimizing loss of hole diameter compared to conventional well construction methods.

We claim:

1. A method of creating a wellbore in an underground formation comprising drilling a borehole in the underground formation using a drilling tubular, capable of being expanded, to which a downhole motor driving a drill bit has been connected, and, after drilling to a desired casing setting depth, expanding the drilling tubular into place to line the borehole by applying a radial load to the drilling tubular and removing said load from the drilling tubular.

2. The method of claim 1, wherein the drilling tubular is stored on a reel before the drilling and unreeled from the reel during the drilling.

3. The method of claim 1, wherein the material of the drilling tubular is capable of sustaining a plastic deformation of at least 10% uniaxial strain.

4. The method of claim 1, wherein an expandable mandrel or swage section, being an integral part of the drilling bit, is latched with the drilling tubular and is pulled back through the drilling tubular after drilling to the desired casing setting depth, expanding the drilling tubular on the way out the wellbore.

5. The method of claim 1, wherein an expandable mandrel or swage section is built on the top of the bit, latched on to the bit with the drilling tubular and pulled back through the drilling tubular after drilling to the desired casing setting depth, expanding the drilling tubular on the way out the wellbore.

6. The method of claim 1, wherein after drilling to the desired casing setting depth the drilling tubular is expanded by moving an expansion unit through the drilling tubular from the top until the unit reaches the bottom of the tubular, whereafter the unit latches onto the drilling bit or device and the drilling is continued.

7. The method of claim 1, wherein a sealing material in a fluidic state is pumped between the drilling tubular and the wellbore wall prior to applying said radial load to the drilling tubular which sealing material sets after the radial expansion.

8. The method of claim 7, wherein the sealing material sets by the mechanical energy exerted to the sealing material by the radial expansion of the drilling tubular.

9. The method of claim 7, wherein the sealing material sets by circulating the sealing material between the drilling tubular and the wellbore wall and putting a hardener into the sealing material.

10. The method of claim 1, wherein a drill fluid is utilized that can be turned into an external sealing material after the radial expansion.

11. The method of claim 1, wherein formation flow is sealed off by radially expanding the drilling tubular.

12. The method of claim 7, wherein the expansion mandrel is utilized as a wiper plug for removing sealing fluid from the inside of the drilling tubular after the expansion.

* * * * *